US006894613B2

(12) United States Patent
Stab

(10) Patent No.: US 6,894,613 B2
(45) Date of Patent: May 17, 2005

(54) OPERATOR CONTROLLER WITH COMBINATION OF ALERT AND MESSAGE, OPERATOR PROVIDED THEREWITH AND METHOD FOR OPERATING SAME

(75) Inventor: Axel Stab, Berlin (DE)

(73) Assignee: Hormann KG Antriebstecknik, Halle I. Westfalen (DE)

( * ) Notice: Subject to any disclaimer, the term of this patent is extended or adjusted under 35 U.S.C. 154(b) by 0 days.

(21) Appl. No.: 10/319,819

(22) Filed: Dec. 16, 2002

(65) Prior Publication Data

US 2003/0128129 A1 Jul. 10, 2003

(30) Foreign Application Priority Data

Dec. 20, 2001 (DE) ..... 201 20 655 U
Nov. 20, 2002 (EP) ..... 02026311

(51) Int. Cl.[7] ..... G08B 13/08
(52) U.S. Cl. ..... 340/545.1; 49/13; 160/10
(58) Field of Search ..... 340/545.1, 545.2; 49/13, 14; 116/86; 160/10

(56) References Cited

U.S. PATENT DOCUMENTS 5,565,843 A * 10/1996 Meyvis ..... 340/691.6
5,986,561 A * 11/1999 Kuruvilla et al. ..... 340/691.5
6,707,374 B1 * 3/2004 Zaharia ..... 340/5.31

FOREIGN PATENT DOCUMENTS

DE 20010314 6/2001

* cited by examiner

*Primary Examiner*—Jeffery Hofsass
*Assistant Examiner*—Jennifer Stone
(74) *Attorney, Agent, or Firm*—Stevens, Davis, Miller & Mosher, LLP

(57) ABSTRACT

The invention relates to an operator controller for controlling an operator for a powered closure of a building or enclosure, more particularly a door operator controller, including an apparatus for informing a user as to the operating status of the operator controller and/or of the operator to be controlled or of the closure to be powered, especially as to a status requiring user intervention. To avoid unnecessary service calls it is proposed that the operating status information apparatus comprises an apparatus for outputting a combination of a warning signal and message clearly indicating the operating status, preferably without the assistance of any further information. The invention also relates to an operator provided therewith as well as to a method of operating same.

21 Claims, 4 Drawing Sheets

FIG. 1
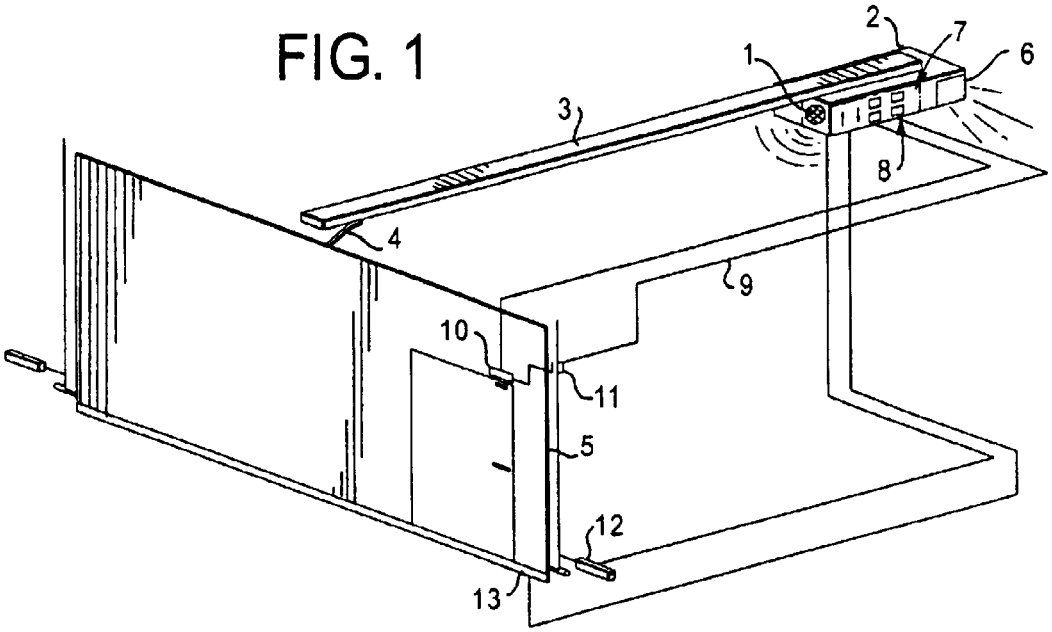
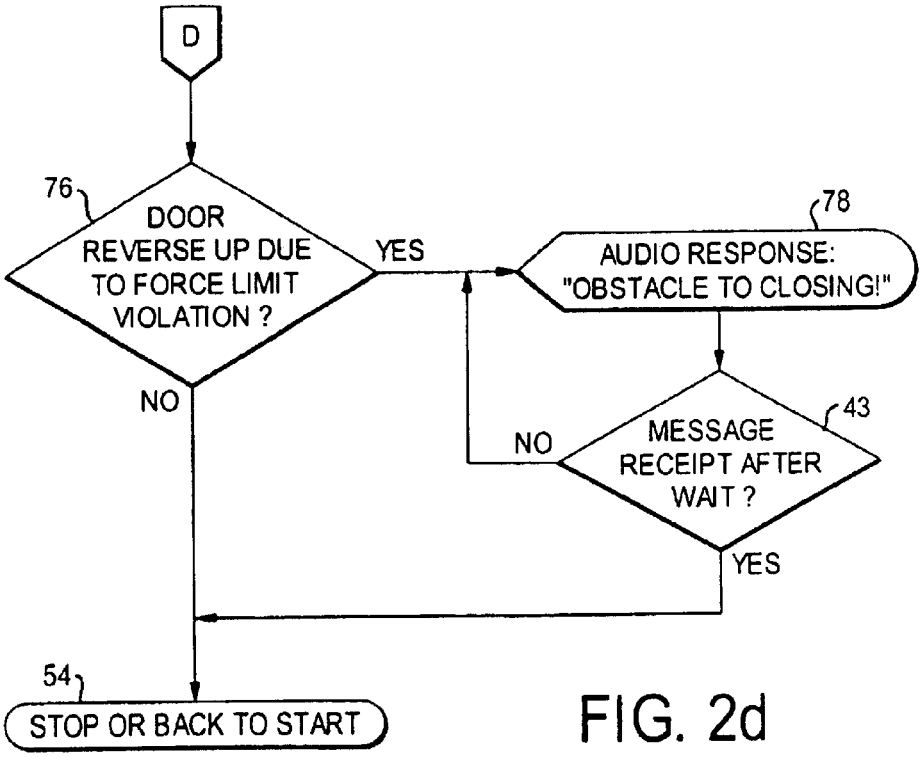
FIG. 2d

OPERATOR CONTROLLER WITH COMBINATION OF ALERT AND MESSAGE, OPERATOR PROVIDED THEREWITH AND METHOD FOR OPERATING SAME

This claims priority under 35 USC Section 119 of German Utility Application 201 20 655.2 of Dec. 20, 2001, and European Patent Application 02 026 311.7 of Nov. 20, 2002, both of which are incorporated herein by reference in their entirety.

FIELD OF THE INVENTION

The invention relates to an operator controller of the kind for controlling an operator for a powered closure of a building or enclosure, as for example known from German utility model DE 200 10 314 U1, incorporated herein by reference in its entirety, as well as to an operator provided therewith. In addition, the invention relates to a method of operating such an operator and controller respectively.

PRIOR ART

It is generally the situation with current (garage door) operators that when at fault or an unusual situation (i.e. unexpected by the user) occurs, it is only the operator that reacts according to the circumstances whilst leaving the user in the dark as to why it has reacted thus.

Although many operators include a visual alert indicating the cause of the trouble, this display is discrete and usually coded by displaying a train of digits or a flashing lamp sequence which is of no immediate help to the user in such a nuisance situation since it usually requires him to look up the cause in the Operating Manual of the device.

One example in the field of garage door operators is a light beam sensor in the doorway which, as soon as the light beam is interrupted, a) halts an already commenced door closing action and then instantly reversing the operator to UP or b) prevents door closing (door remains open despite being instructed to close, i.e. wanted door closing action is not even commenced).

The cause for b) for instance, could be simply that the user has placed his bag accidental blocking the light beam.

The user fails to understand the reaction of the operator (door will not close) and thus he assumes the operator is defective. This prompts him to call in the service people to correct the defect. Instead, the operator has reacted quite correctly and could be reinstated quite simply (in this case by removing the bag).

Saving such unnecessary service calls is in the interest of both the user and the maker/dealer/fitter of the system. This is why the following describes a method and means for practically eliminating such situations.

SUMMARY OF THE INVENTION

It is thus the objective of the invention to configure or operate an operator controller of the kind for controlling an operator for a powered closure of a building or enclosure, including a means for informing a user as to the operating status of said operator controller and/or of said operator to be controlled or of said closure to be powered so that such unnecessary service calls can now be avoided.

This objective is achieved by an operator controller, an operator and an operating method.

The solution approach as described in the following is based on the user now being clearly informed as to the unexpected or wanted reaction of the operator whilst disclosing the cause and indicating, where necessary, what is to be done.

This may be achieved by a combination of visual messages (some of which may already exist) and audio messages as regards the operator and its controller.

BRIEF DESCRIPTION OF THE DRAWINGS

Example embodiments of the invention will now be detailed with reference to the attached drawing in which:

FIG. 1 is a diagrammatic illustration of a door operator, and

FIGS. 2*a*, 2*b*, 2*c*, 2*d* are each a part of a flow chart illustrating the sequence of events in operation of a door operator as shown in FIG. 1.

DETAILED DESCRIPTION OF PREFERRED EMBODIMENTS

Figure 2A:
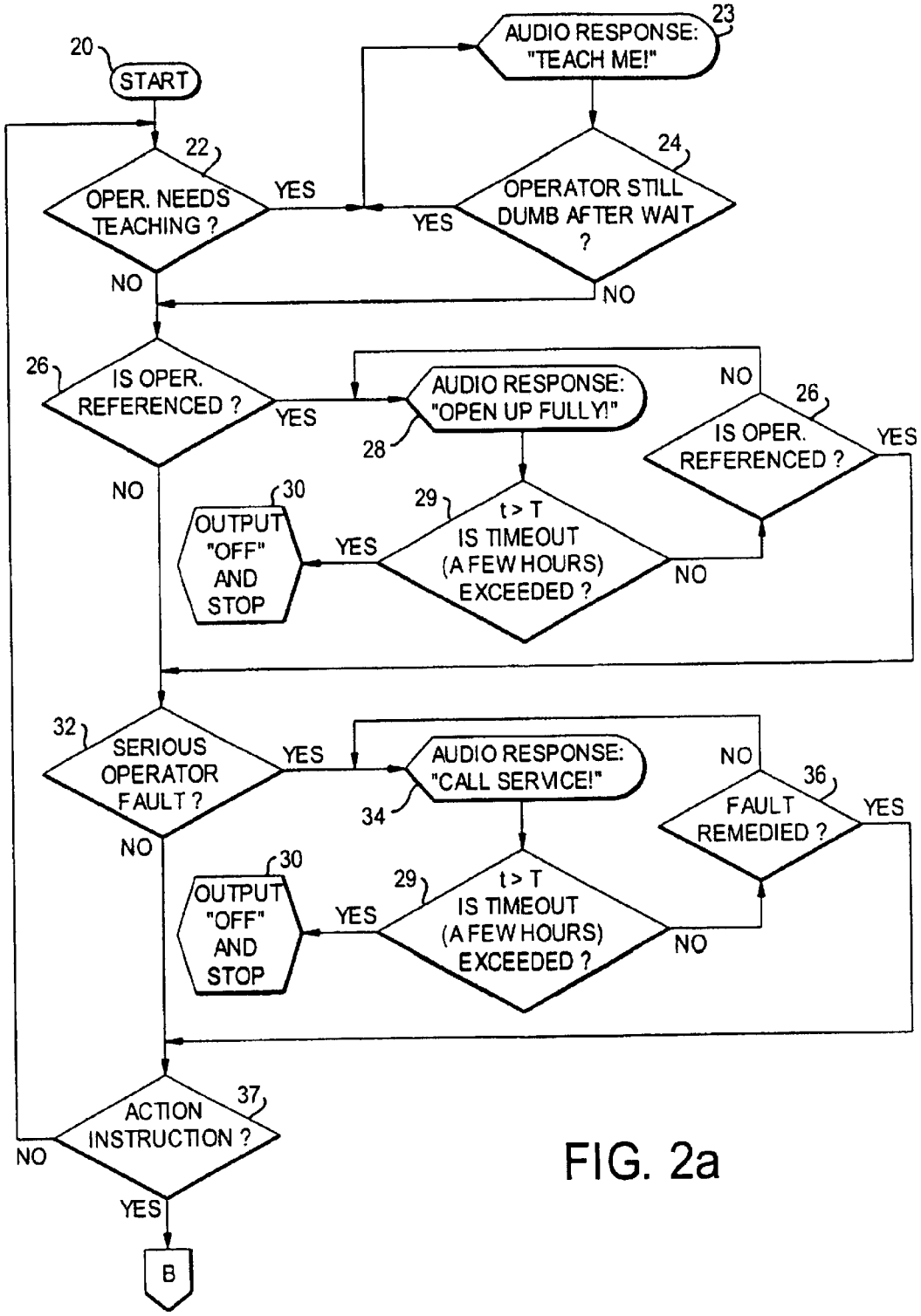

Referring now to FIG. 1 there is illustrated a door operator comprising a motor housing 2, a loudspeaker 1 and a transmission 3 in the form of a guide rail mounting a carriage 4. The door operator powers a door panel identified by reference numeral 5. The door operator includes further a lamp unit 6, a display device 7 displaying in this case pictograms (diagrammatically shown by squares and arrows) and a door operator controller 8 accommodated in the housing 2. The controller 8 comprises a microcontroller (not shown) in which the individual control units are achieved by means of software circuits. The door operator controller is identified by reference numeral 8 and indicated by a dot-dashed line. Connected to the controller 8 is a halt circuit 9 including an escape door switch 10 and a pull-cord switch 11. Connected furthermore to the controller 8 is a light beam sensor 12 and an closing edge sensor 13.

The door operator as shown is devised by means of its controller 8 to alert a user clearly to an unexpected accidental reaction of the operator whilst disclosing the cause thereof and, where necessary, indicating the solution to the problem.

This is done preferably by a combination of audiovisual messages.

For this purpose, as shown in FIG. 1, an audio response is provided via the loudspeaker 1.

Figure 2B:
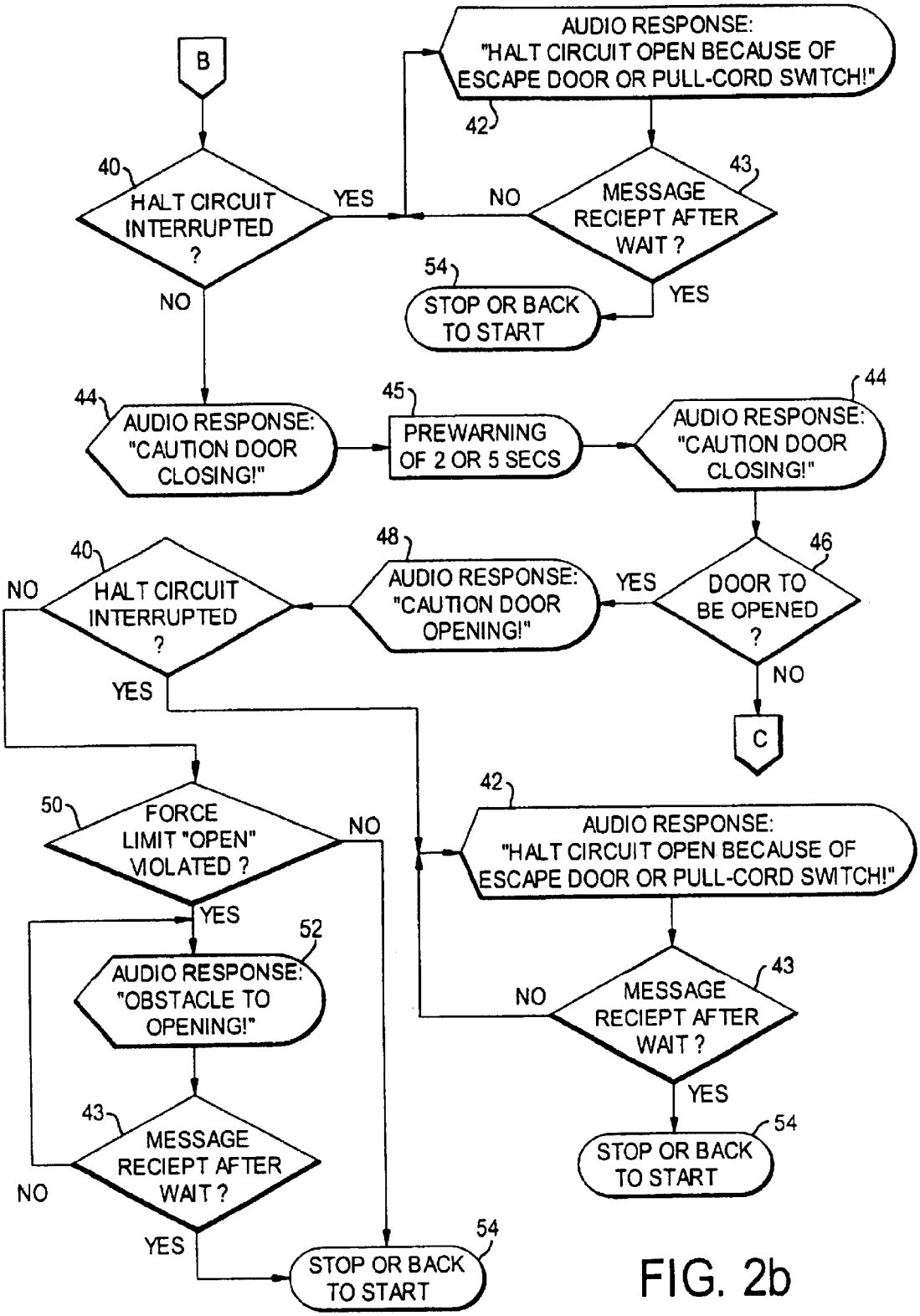
Figure 2C:
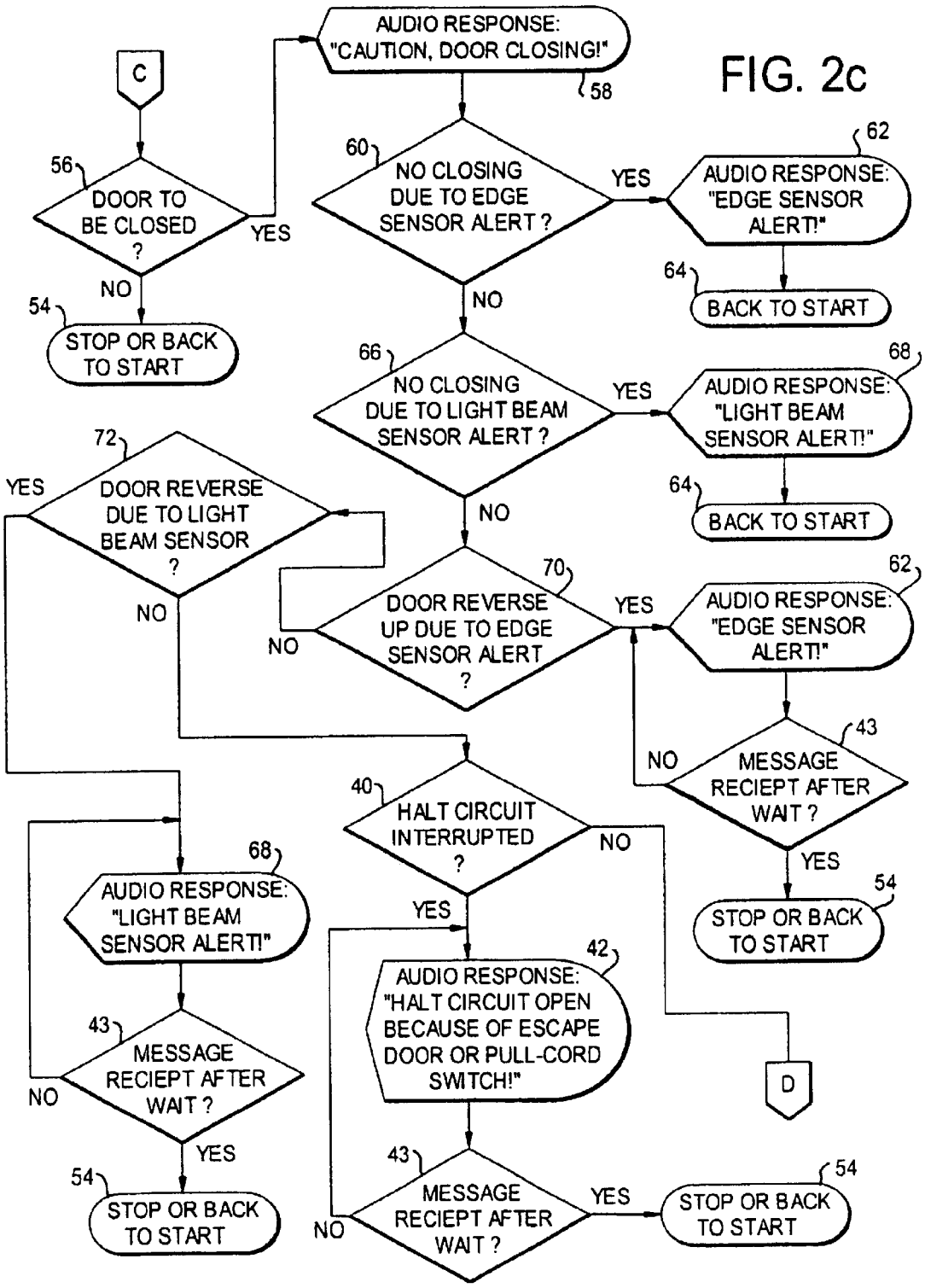

A method of operating the audio response unit is evident from the flow chart as shown in FIGS. 2*a*–2*d*, which is self-explanatory on the basis of the following legends:

20 start;
22 operator needs teaching?,
23 audio response: "Teach me!";
24 operator still dumb after wait?;
26 is operator referenced?;
28 audio response: "Open up fully!";
29 Is timeout (a few hours) exceeded?;
30 output "OFF" and stop:
32 serious operator fault?
34 audio response: "Call service!";
36 fault remedied?;
37 action instruction?;
40 halt circuit interrupted?;
42 audio response: "halt circuit open because of escape door or pull-cord switch!";
43 message receipt after wait?;

44 audio response: "Caution door closing!";
45 prewarning of 2 or 5 secs;
46 door to be opened?;
48 audio response: "Caution door opening!";
50 force limit "open" violated?;
52 audio response: "obstacle to opening!";
54 stop or back to start;
56 door to be closed?;
58 audio response: "Caution, door closing!";
60 no closing due to edge sensor alert?;
62 audio response: "edge sensor alert!";
64 back to start;
66 no closing due to light beam sensor?;
68 audio response: "light beam sensor alert";
70 door reverse UP due to edge sensor alert?;
72 door reverse due to light beam sensor?;
76 door reverse UP due to force limit violation"?;
78 audio response: "obstacle to closing!".

Special Messages by Audio Response and Coded Display (See DE 200 10 314 U1 to which Express Reference is Made as Regards Further Details, Particularly as Regards Configuration and Function)

Scenario: The (garage door) operator includes a loudspeaker 1, or it can be connected thereto, for outputting short texts in the spoken language of the country concerned pertinent to the various situations as prompted by the operator controller 8. In addition, a visual alert as a combination of digits, flashing lamp sequences, etc is displayed coded.

The audio response can be programmed (as to language of the country concerned, volume down to completely OFF, only for alerts as to unexpected reactions, etc) and could involve the following (not conclusive) listed in Table 1:

TABLE 1

| situation/ reaction | Possible spoken text | remarks |
|---|---|---|
| Door UP (normal) | Caution door opening! | expected reaction; optional either only on commencement or continually during door movement |
| Door DOWN (normal) | Caution door closing! | expected reaction; optional either only on commencement or continually during door movement |
| Reverse UP due to force limit violation DOWN | Obstacle to closing! | unexpected reaction; on commencement of reverse movement and then e.g. with wait periods until cancelled |
| Stop due to force limit violation UP | Obstacle to opening! | expected reaction; on stop and then e.g. with wait periods until cancelled |
| Reverse UP due to closing edge sensor alert | closing edge sensor alert! | unexpected reaction; on commencement of reverse movement and then e.g. with wait periods until cancelled |
| No closing due to closing edge sensor alert | closing edge sensor alert! | unexpected reaction; every time closing cannot be started |
| Reverse action due to light beam sensor | light beam sensor alert! | unexpected reaction; on commencement of reverse action and then e.g. with wait periods until cancelled |
| No closing due to light beam sensor | light beam sensor alert! | unexpected reaction; every time closing cannot be started |
| Stop due to interrupt of halt circuit (due to escape door contact or pull cord switch) | halt circuit interrupt due to escape door contact or pull cord switch | unexpected reaction; every time a door action cannot be started and when this prompts a stop and then e.g. with wait periods until cancelled |
| During door open time | Caution, door closes automatically in x seconds | expected reaction; e.g. count-down output |
| During prewarning time | Caution, door action! or just: caution! | expected reaction; on commencement and shortly before end of prewarn time (which is only 2 or 5 secs long) |
| Operator needs teaching | Teach me! | unexpected reaction; e.g. message is repeated with wait periods until teaching accomplished |
| Serious operator fault | Call in service! | unexpected reaction; e.g message is repeated with wait periods and operator "OFF" after a few hours |
| Operator has no references; e.g. following power failure | Open up fully! | unexpected reaction; e.g. message is repeated with wait periods and operator "OFF" after a few hours. |

Special Messages by an Audio Signal with the Possible Addition of a Coded Display Whilst the solution as described in [0019] is fully comprehensive it is sometimes sufficient to simply "accompany" certain unexpected reactions often occuring from experience.

The following relates to the example with the light beam sensor 12 as cited in [0005].

Scenario: The (garage door) operator includes an audible signal device 1, or it can be connected thereto, by means of which audio signals can be put out when the light beam of the sensor 12 is interrupted, an already commenced door closing action is halted and the operator then immediately caused to reverse up to the door UP position or closing is prevented (door remains open despite action instruction, the wanted closing action being ignored.

These audio signals are put out only when the operator has an unexpected reaction; "normal" passing the light beam sensor 12 when the door is e.g. open or in opening action is not "commented".

These audio signals may continue until cancelled or cease on count out; optionally it may be completely disabled.

Since these audio signals are associated only with the light beam sensor 12, the user is clearly aware that the unexpected reaction is because of the light beam sensor 12 and he is thus able to localize and remedy the situation by e.g. simply removing the bag as mentioned in [0006].

An additional coded digit or flashing lamp sequence display 7 (lamp 6) could be provided independently of the above.

Special Visual Alerts with the Possible Addition of a Coded Display

One variation of the solution as described in [0021] is to either replace or supplement the audible signal device(s) by an additional or already installed visual component such as e.g. operator lamp 6 to "accompany" unexpected reactions of the operator.

Thus the audible signals as described in [0021] may be supplemented or replaced by e.g. flashing signals of the operator lamp 6 which may also be rendered adjustable the same as the audible signals.

Since flashing is associated only with the light beam sensor 12, the user is clearly aware that the unexpected reaction is because of the light beam sensor 12 and is thus able to localize and remedy the situation by e.g. simply removing the bag as mentioned in [0006].

An additional coded digit or flashing lamp sequence display could be provided independently of the above.

Special Messages by Audible or Visible Signals with Clear Text Display

As an alternative to the audio response in [0019] it is likewise conceivable to replace a coded digit or flashing lamp sequence display by a clear text display. The audio response as indicated in [0019] then being displayed as clear text.

To alert the user to this display in an unexpected reaction an audio or visual alerting as described in [0021] or [0028] e.g. by flashing of the operator lamp 6 is additionally provided.

Special Messages by a Combination of Signals and Clear Text Output

It is, of course, just as possible to employ audio response, spoken text, voiced alert, clear text display, audio signals or/and visual signals in any special combination in accordance with any particular application.

The important thing in this case is simply that the user is clearly alerted to the cause of the unexpected reaction in giving him the opportunity to react accordingly.

Concrete Embodiment

A further concrete embodiment of the invention materializes from supplementing the operator controller as described in DE 200 10 314 U1 by means for combining a warning signal, for instance a flashing signal at the door operator controller 8, an additional audio signal or an additional (unusual) visual signal such as (unusual) flashing of the usual door operator lamp 6 with a spoken message which is easy to understand.

The message informing the user as to operating status and/or the remedying steps needed could also be e.g. a pictogram which is illuminated or produced on a display matrix.

What is claimed is:

1. An operator controller for controlling an operator for a powered closure of a garage door of a building or enclosure, including:

operating status information means for informing a user of a garage door of an unexpected reaction of said operator controller and/or of said operator to be controlled or of said closure to be powered, wherein said operating status information means comprises means for outputting a combination of a warning signal and a message, which indicates clearly said operating status by displaying said operating status of said operator necessitating user intervention by a warning signal and a message disclosing the cause for the unexpected reaction without the assistance of any further information.

2. The operator controller as set forth in claim 1, wherein said warning signal comprises an audio and/or visual signal.

3. The operator controller as set forth in claim 2, wherein said visual signal comprises flashing of a lamp provided on said operator.

4. An operator for a powered closure of a garage door of a building or enclosure, comprising an operator controller as set forth in claim 2.

5. An operator for a powered closure of a garage door of a building or enclosure, comprising an operator controller as set forth in claim 3.

6. The operator controller as set forth in claim 1, wherein said message is or comprises at least one member of the group consisting of a voiced message, a clear text display and display of a pictogram.

7. An operator for a powered closure of a garage door of a building or enclosure, comprising an operator controller as set forth in claim 6.

8. An operator for a powered closure of a garage door of a building or enclosure, comprising an operator controller as set forth in claim 1.

9. A method of operating an operator as set forth in claim 8, comprising: displaying an operating status of said operator necessitating user intervention by a warning signal and a message clearly indicating said operating status without the assistance of any further information.

10. The method as set forth in claim 9, wherein said visual signal comprises flashing of a lamp provided on said operator.

11. The method as set forth in claim 9, wherein said message is or comprises at least one member of the group consisting of a voiced message, a clear text display and display of a pictogram.

12. The method as set forth in claim 9, wherein an unexpected reaction of said operator is explained by said voiced message and/or clear text display.

13. The method as set forth in claim 9, wherein a voiced message and/or clear text display indicates at least one operating state selected from the group consisting of Door opening;

Door closing;

Door reversal or stop due to
force limit violation,
edge sensor activated,
light beam sensor activated or
interrupted halt circuit;

No door start due to
edge sensor activated,
light beam sensor activated or
interrupted halt circuit AUTO door start in a few seconds;

Operator needs learning;

No reference values due to power failure and/or

Serious operator fault.

14. The method as set forth in claim 9, wherein said operating status is indicated by a voiced message and/or a clear text display.

15. The method as set forth in claim 9, wherein said warning signal comprises an audio and/or visual signal.

16. The method as set forth in claim 9, wherein said warning signal is output by a voiced alert and/or by an audio signal.

17. The method as set forth in claim 9, wherein an expected reaction is announced by said voiced message.

18. The operator controller as set forth in claim 1 wherein said warning signal is selected from the group consisting of a voiced alert, beeping, hooting and/or a sequence of several warning sounds.

19. An operator controller for controlling an operator for a powered closure of a garage door of a building or enclosure, including:

operating status information means for informing a user of a garage door of an unexpected reaction of said garage door, wherein said operating status information means comprises means for outputting a combination of a warning signal and a message, which indicates clearly said operating status by displaying said operating status of said operator necessitating user intervention by a warning signal and a message disclosing the cause for the unexpected reaction without the assistance of any further information.

20. The operator controller of claim 19, wherein said operating status information means comprises means for informing the user of the garage door of garage door not opening when instructed to open by the user.

21. The operator controller of claim 19, wherein said operating status information means comprises means for informing the user of the garage door of garage door not closing when instructed to close by the user.

* * * * *